US012146323B2

(12) United States Patent
Taylor et al.

(10) Patent No.: US 12,146,323 B2
(45) Date of Patent: Nov. 19, 2024

(54) INFILL ADAPTOR FOR A BALUSTRADE

(71) Applicant: Meshtec International Co., Ltd, Chiang Mai (TH)

(72) Inventors: Peter Syme Taylor, New Farm (AU); David Neil Edlin, Chiang Mai (TH)

(73) Assignee: Meshtec International Co., Ltd, Chiang Mai (TH)

( * ) Notice: Subject to any disclaimer, the term of this patent is extended or adjusted under 35 U.S.C. 154(b) by 216 days.

(21) Appl. No.: 17/731,490

(22) Filed: Apr. 28, 2022

(65) Prior Publication Data

US 2022/0356714 A1 Nov. 10, 2022

Related U.S. Application Data

(60) Provisional application No. 63/186,501, filed on May 10, 2021.

(51) Int. Cl.
*E04F 11/18* (2006.01)

(52) U.S. Cl.
CPC ..... *E04F 11/1817* (2013.01); *E04F 11/1851* (2013.01); *E04F 11/1855* (2013.01); *E04F 2011/1821* (2013.01); *E04F 2011/1831* (2013.01)

(58) Field of Classification Search
CPC ..... E04F 11/1817; E04F 11/1851; E04F 2011/1831; E04F 2011/1829; E04F 11/1853; E04F 11/1855; E04F 11/1812; E04F 2011/1823; E04F 2011/1821; E04F 2011/1827
USPC ..... 256/29–31; 52/238.1
See application file for complete search history.

(56) References Cited

U.S. PATENT DOCUMENTS

| | | | | |
|---|---|---|---|---|
| 4,993,204 | A * | 2/1991 | Kuritsky | E04C 2/384 52/656.2 |
| 5,200,240 | A * | 4/1993 | Baker | E04F 11/1853 52/690 |
| 6,230,455 | B1 * | 5/2001 | Arehart | E06B 9/02 52/202 |
| 7,712,268 | B1 * | 5/2010 | Guthrie | E06B 5/003 52/202 |
| 10,837,228 | B2 * | 11/2020 | Roberts | E06B 9/52 |
| 11,808,083 | B2 * | 11/2023 | Roberts | E06B 9/52 |
| 2011/0017965 | A1 * | 1/2011 | Kowalewicz | E04H 17/16 29/527.2 |
| 2020/0354964 | A1 * | 11/2020 | Rhayem | E04F 11/1846 |

* cited by examiner

*Primary Examiner* — Brent W Herring
(74) *Attorney, Agent, or Firm* — Fitch, Even, Tabin & Flannery, LLP

(57) ABSTRACT

An infill adaptor for mounting a screen between upper and lower rails of a balustrade. The upper and lower rails have respective channels which open toward each other. The infill adaptor has a generally L-shaped body with a rail engaging leg extending generally perpendicular to a sash engaging leg. A respective rail engaging leg is mounted in each of the channels for securing an infill adaptor to each rail. The sash engaging leg is secured to the sash of a screen for mounting a screen to the rails.

6 Claims, 7 Drawing Sheets

INFILL ADAPTOR FOR A BALUSTRADE

CROSS-REFERENCE TO RELATED APPLICATION

This application claims the benefit of U.S. Provisional Application No. 63/186,501, filed May 10, 2021, which is incorporated herein by reference in its entirety.

FIELD OF INVENTION

The present invention relates to balustrade arrangements having infill panels. More particularly, the present invention relates to an adaptor for mounting a screen infill between two balustrade rails configured to mount a glass infill panel.

BACKGROUND OF THE INVENTION

A balustrade is basically a railing arrangement in which vertical columns support upper and lower rails. An infill is typically used to fill in a space between the upper and lower rails. Balustrade arrangements are commonly found along balconies and stairs but a similar configuration may also be used in fencing applications.

A common infill is a glass panel. The glass panel is supported along upper and lower edges thereof by channels extending along the upper and lower rails which receive the upper and lower edges respectively of the glass panel.

An object of the present invention is to provide an infill adaptor for mounting a screen infill in place of a glass infill without having to change or modify the profiles of the rails.

SUMMARY OF THE INVENTION

An infill adaptor is provided for mounting a screen between upper and lower rails of a balustrade. Each upper rail has a downwardly facing upper channel opposite a corresponding upwardly facing lower channel in the lower rail.

The screen panel has a generally rectangular sash frame surrounding and secured to a screen panel. The sash frame has an upper sash member opposite a lower sash member and opposite end members extending between the upper and lower members. The infill adaptor has a body with a generally L-shaped cross-section with a rail engaging leg extending generally perpendicular to a sash engaging leg. The rail engaging leg has at least one locating rib extending along its length for registering with the upper or lower channels of the rails to locate the rail engaging leg within the channel. The rail engaging leg is securable to the upper or lower rails by fasteners extending through the rail engaging leg and into a base of the upper or lower channels.

The sash engaging leg is hollow and has an outer wall extending along an edge of the rail engaging leg and an inner wall generally parallel to the outer wall and extending along the top of the rail engaging leg. The screen is securable to the sash engaging leg by fasteners extending through the upper or lower sash members into the inner wall of the sash engaging leg.

DESCRIPTION OF THE DRAWINGS

Preferred embodiments of the present invention are described below with reference to the accompanying drawing in which.

DESCRIPTION OF PREFERRED EMBODIMENTS

Figure 1:
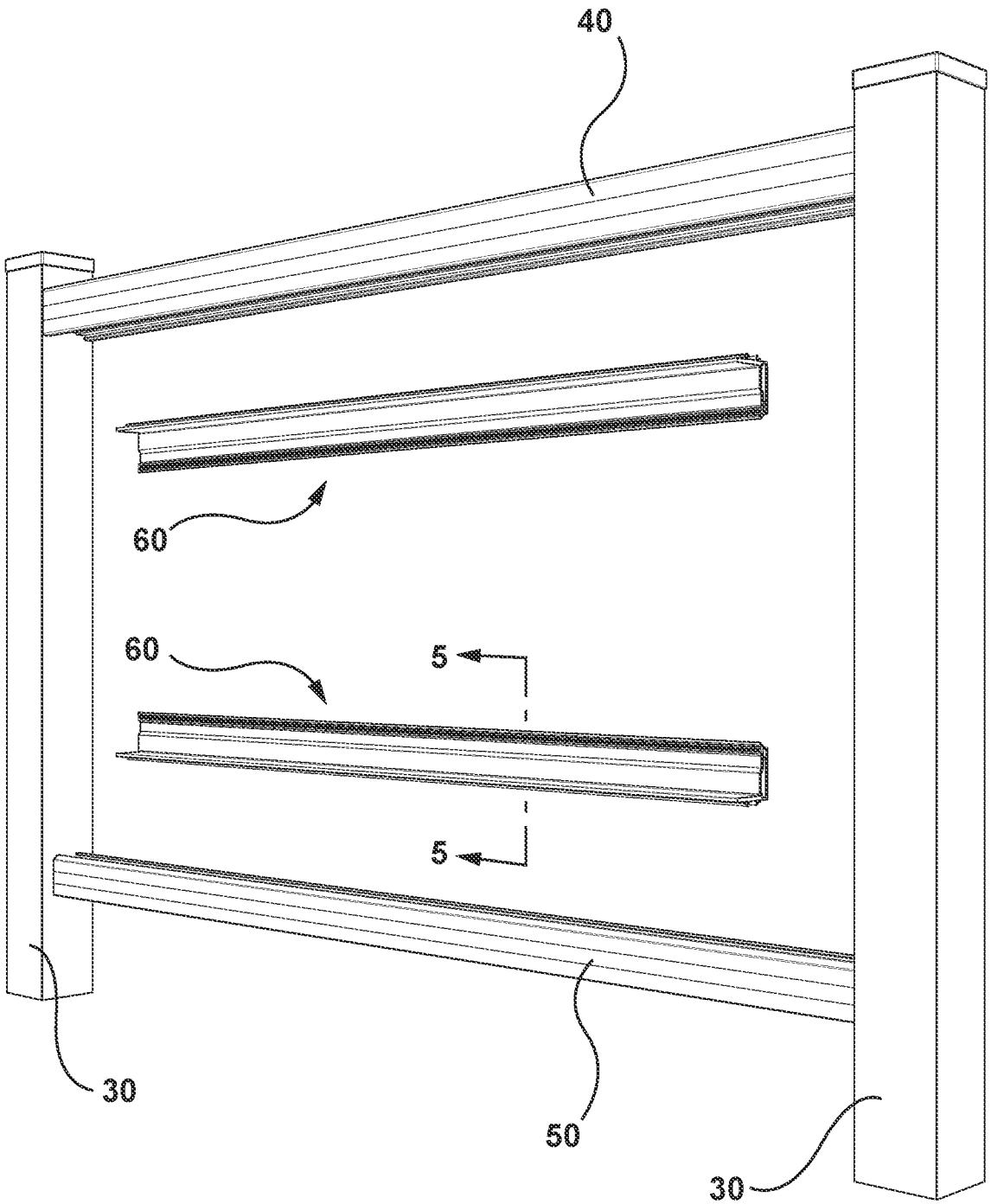
FIG. 1 is an exploded perspective view showing the installation of upper and lower infill adaptors to upper and lower rails of a balustrade.
Figure 2:
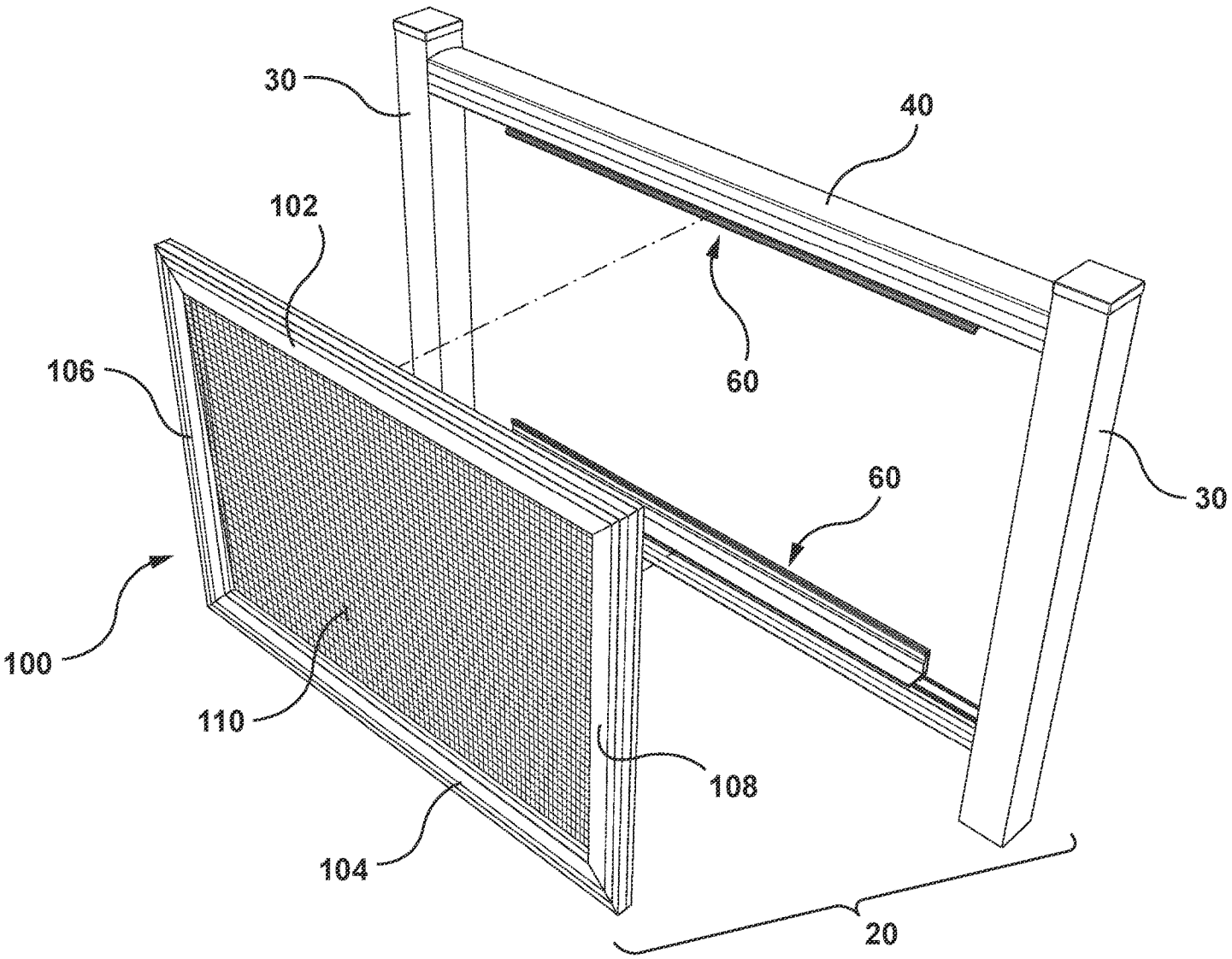
FIG. 2 is an exploded perspective view showing the mounting of a screen to the balustrade.
Figure 3:
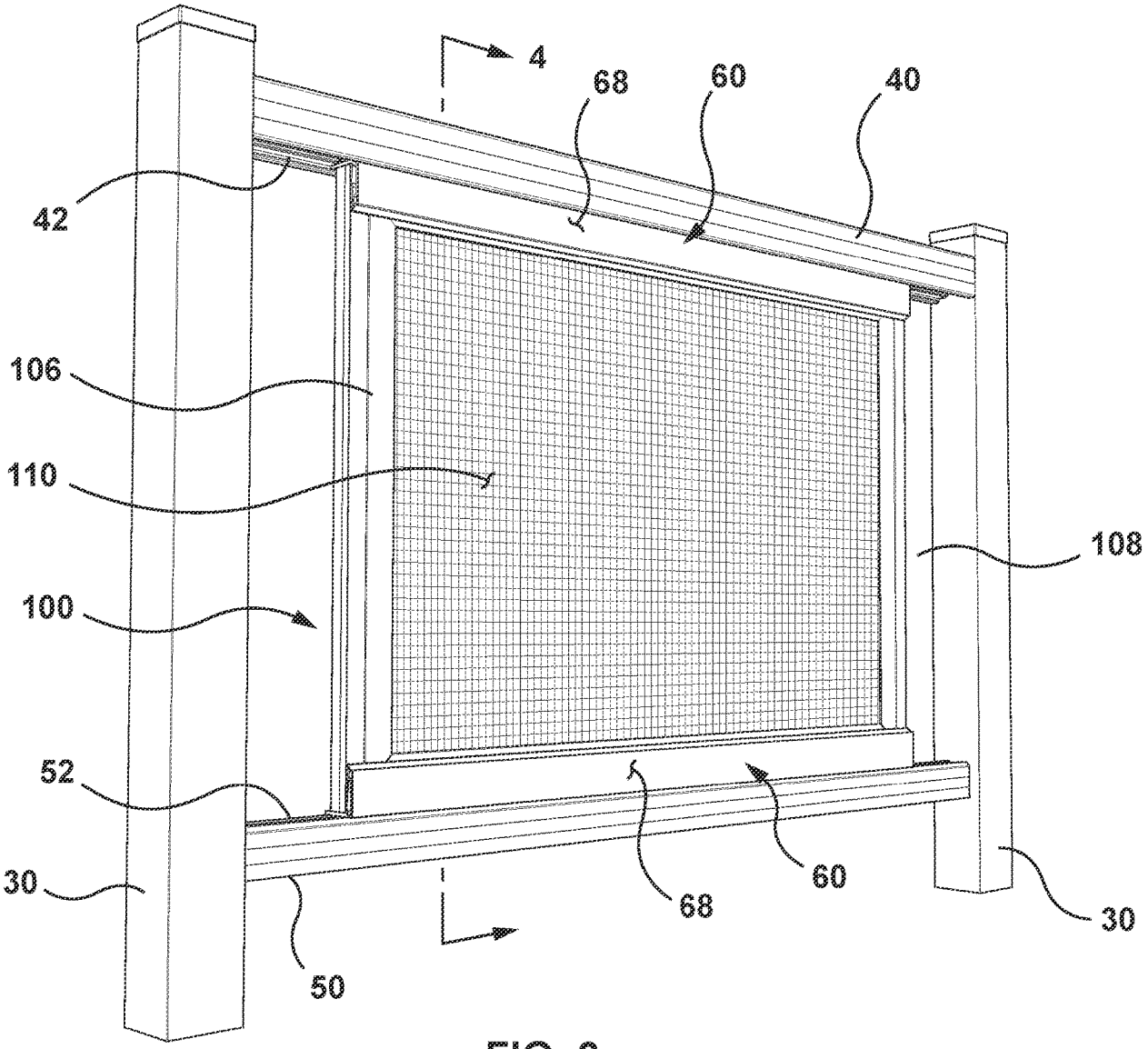
FIG. 3 is a perspective view of a balustrade having a screen panel mounted therein.
Figure 4:
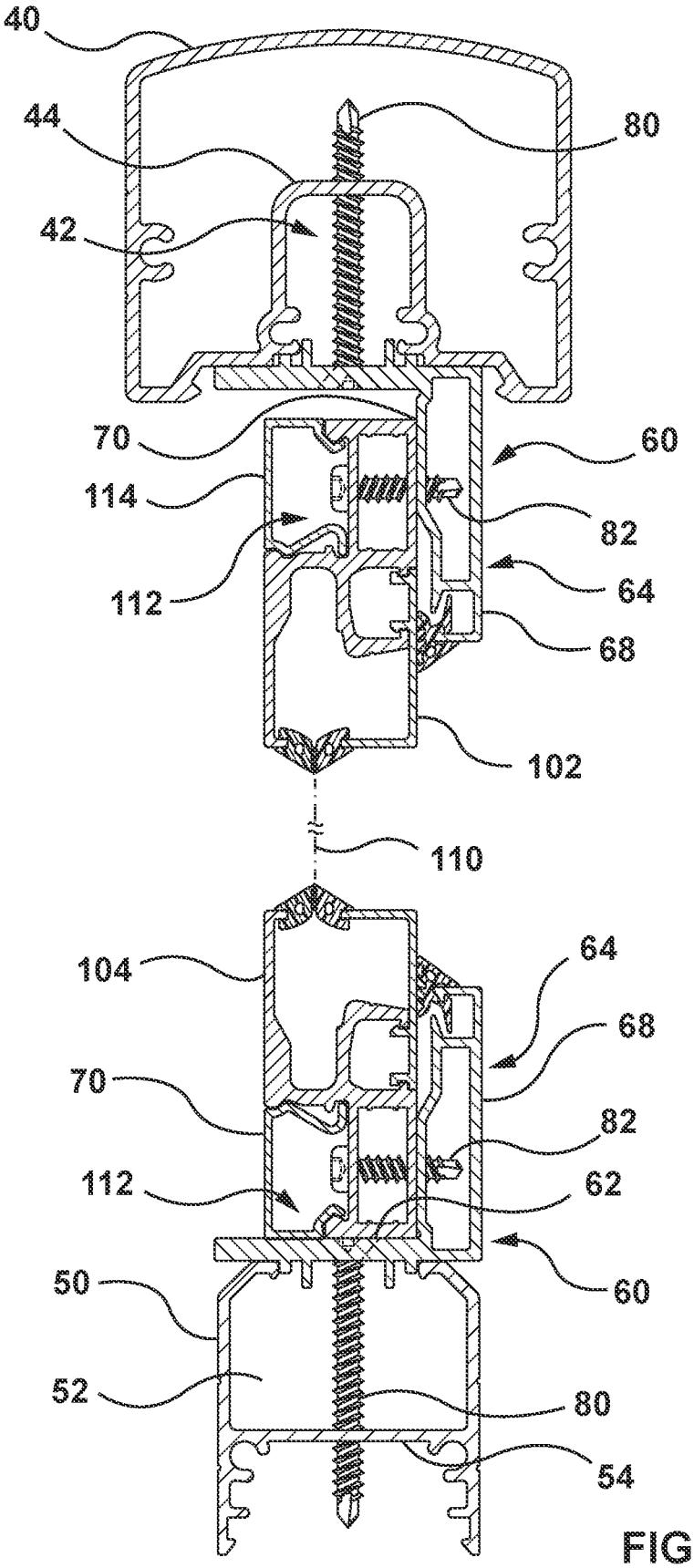
FIG. 4 is a sectional view taken on line 4-4 of FIG. 3.
Figure 5:
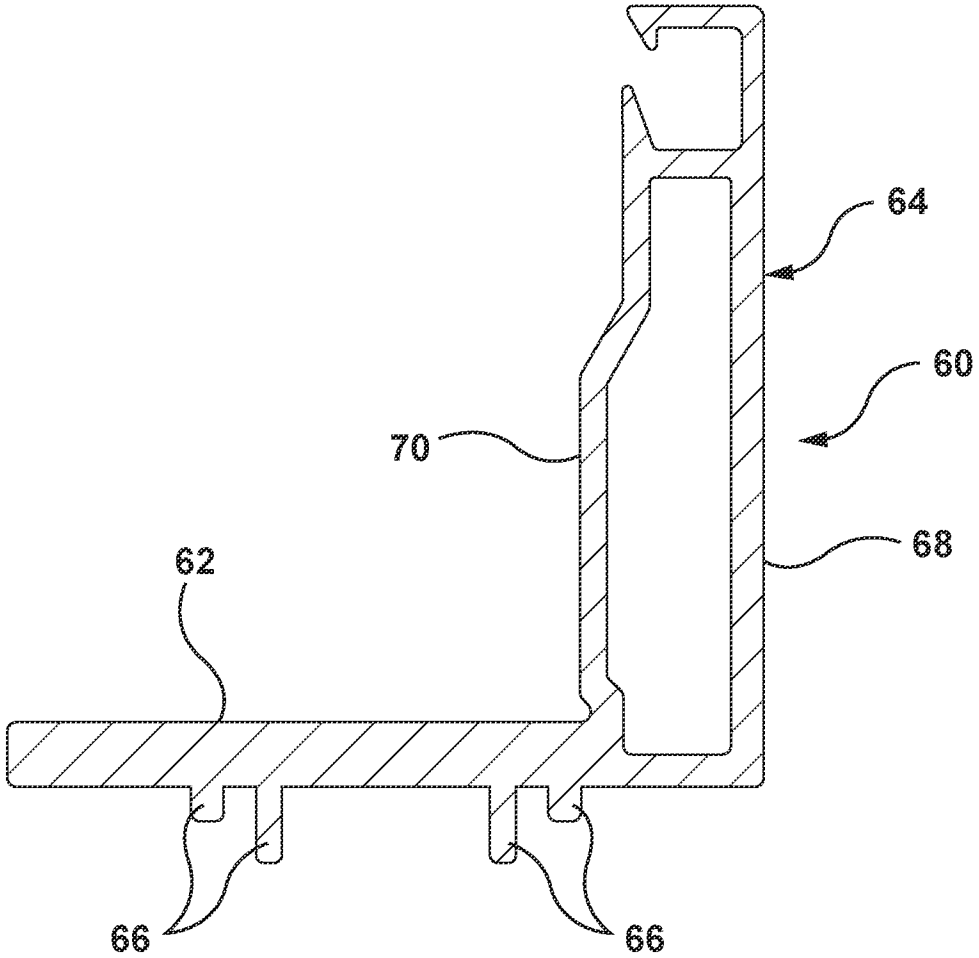
FIG. 5 is a sectional view taken on line 5-5 of FIG. 1.
Figure 6:
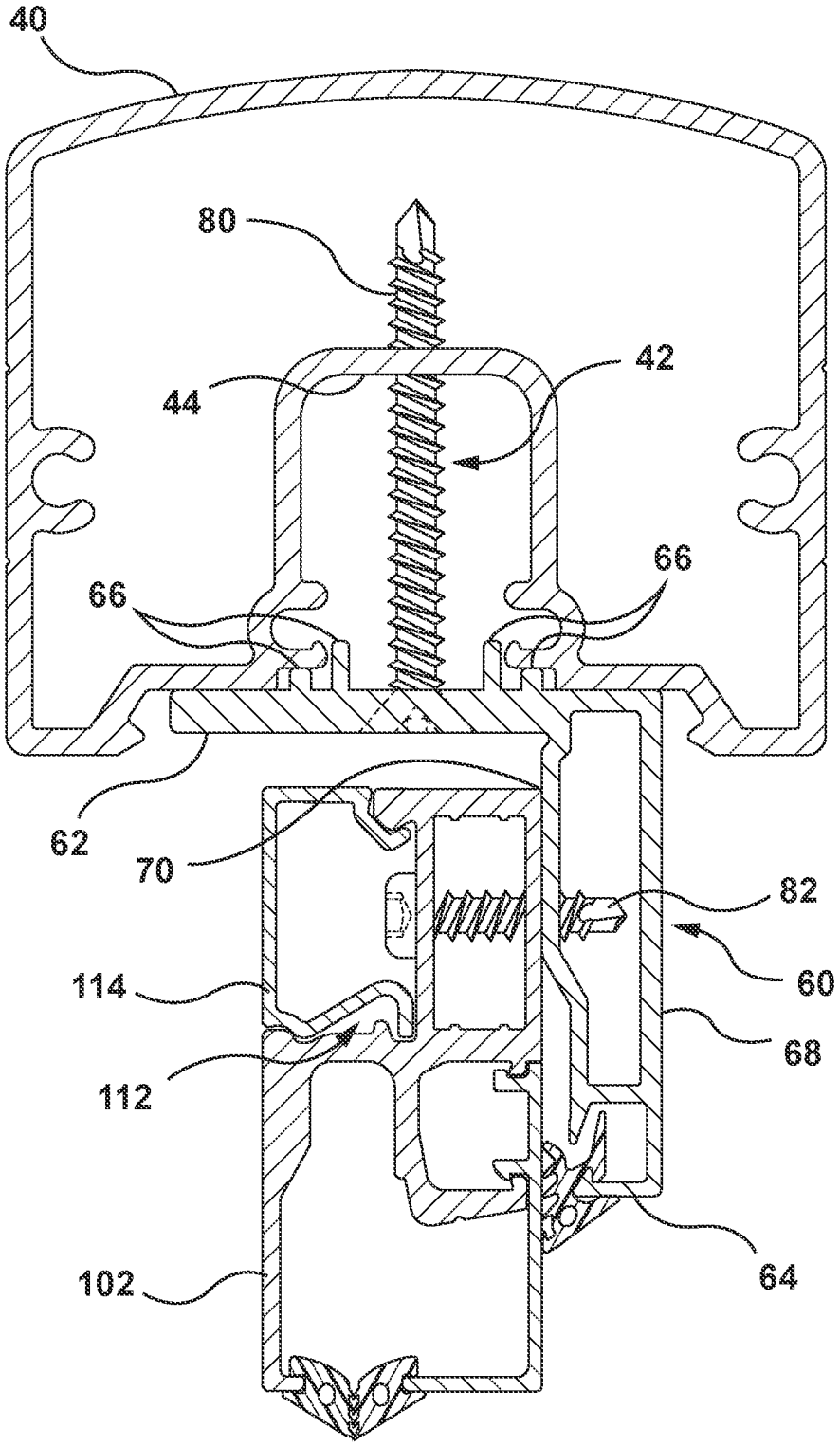
FIG. 6 is an enlargement of the upper portion of FIG. 4.
Figure 7:
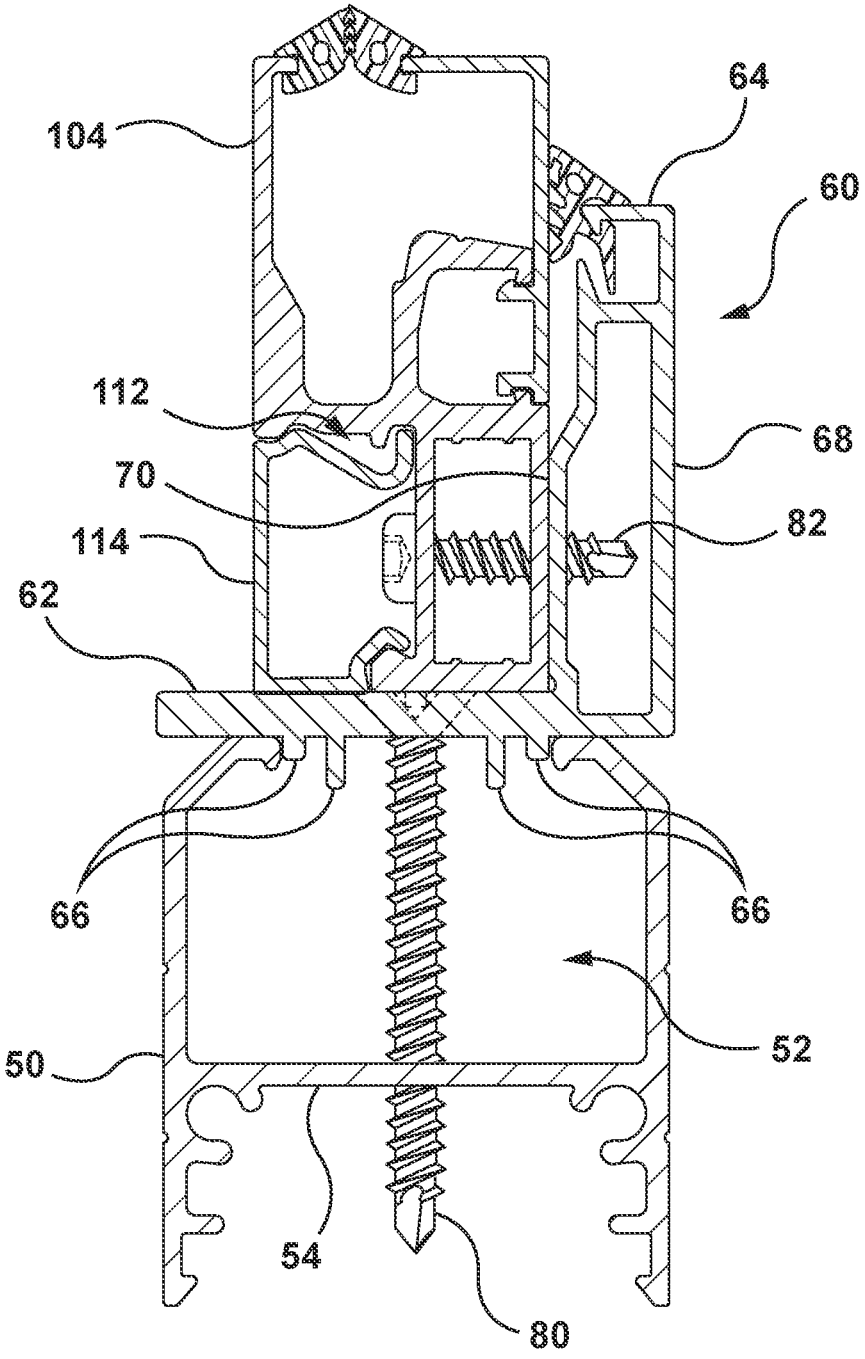
FIG. 7 is an enlargement of the lower portion of FIG. 4.

A balustrade arrangement with a screen infill is generally shown by reference 20 in the accompanying illustrations. The balustrade arrangement 20 has vertical columns 30 which support an upper rail 40 and a lower rail 50 extending between the vertical columns 30.

The upper rail 40 has a downwardly opening upper channel 42 opposite an upwardly opening lower channel 52 in the lower rail 50.

Typically a glass panel (not shown) would be mounted to the upper rail 40 and lower rail 50 with an upper edge of the glass panel being received in the upper channel and a lower edge of the glass panel being received in the lower channel.

Instead of a glass panel, a screen assembly 100 is mounted between the upper rail 40 and lower rail 50. The screen assembly 100 has a generally rectangular sash frame surrounding and secured to a screen panel 110. The sash frame has an upper sash member 102 opposite a lower sash member 104. Opposite end members 106 and 108 extend between the upper and lower members 102 and 104 respectively.

The infill adaptor is generally indicated by reference 60 in the accompanying illustrations. The infill adaptor 60 has a body with a generally L-shaped cross-section with a rail engaging leg 62 extending generally perpendicular to a sash engaging leg 64.

The rail engaging leg 64 has at least one locating rib 66 extending along its length for registering with the upper or lower channels, 42, 52 respectively to locate the rail engaging leg 62 within the channels 42, 52.

The rail engaging leg 62 is securable to the upper or lower rails 42, 52 respectively by screws (or other) fasteners 80 which extend through the rail engaging leg 62 and into a base 44, 54 respectively of the upper or lower channels 42, 52 respectively.

The sash engaging leg 64 is hollow, having an outer wall 68 extending along an edge of the rail engaging leg 62 and an inner wall 70 generally parallel to the outer wall and extending along a top of the rail engaging leg 62.

The screen 100 is securable to the sash engaging leg 64 by fasteners 82 extending through said upper or lower sash member, 102, 104 respectively into the inner wall 70 of the sash engaging leg 64.

The presence of the inner wall 70 makes it possible to secure the fasteners 82 without the fasteners 82 being visible through the outer wall 68 of the sash engaging leg 64.

For improved aesthetics, the upper and lower sash members 102, 104 respectively, may have a recess 112 for receiving the fasteners 82 with a cover plate 114 for obscuring the recess 112 and fastener 82.

The above description is intended in an illustrative rather than a restrictive sense. Variations may be apparent to those skilled in the art while remaining within the scope of the invention as defined by the claims set out below.

PARTS LIST

20 Balustrade arrangement
30 Vertical columns
40 Upper rail
42 Upper channel
44 Base—upper channel
50 Lower rail
52 Lower channel
54 Base—lower channel
60 Infill adaptor
62 Rail engaging leg (REL)
64 Sash engaging leg (SEL)
66 Locating rib (REL)
68 Outer wall (SEL)
70 Inner wall (SEL)
72
74
76
78
80 Fasteners (REL to rail)
82 Fasteners (SEL to sash)
100 Screen
102 Upper sash member
104 Lower sash member
106 End member (sash)
108 End member (sash)
110 Screen panel
112 Recess (for fastener)
114 Cover plate

What is claimed is:

1. An infill adaptor for mounting a screen between upper and lower rails of a balustrade wherein said upper rail has a downwardly opening upper channel opposite a corresponding upwardly opening lower channel in said lower rail, said screen having a generally rectangular sash frame surrounding and secured to a screen panel, said sash frame having an upper sash member opposite a lower sash member and opposite end members extending between said upper and lower members, said infill adaptor comprising:

a body having a generally L-shaped cross-section with a rail engaging leg extending generally perpendicular to a sash engaging leg;

said rail engaging leg having at least one locating rib extending along its length for registering with one of said upper or lower channels to locate said rail engaging leg within said channel;

said rail engaging leg being securable to said upper or lower rails by fasteners extending through said rail engaging leg and into a base of said upper or lower channel, the fasteners extending parallel to the at least one locating rib;

said sash engaging leg being hollow and having an outer wall extending along an edge of said rail engaging leg and an inner wall, generally parallel to said outer wall and extending along a top of said rail engaging leg;

said screen being securable to said sash engaging leg by fasteners extending through said upper or lower sash member into said inner wall of said sash engaging leg.

2. The infill adaptor of claim 1, wherein at least one of said upper and lower sash members has a recess for receiving the fastener and a cover plate removably received by said recess for obscuring the fastener and the recess.

3. The infill adaptor of claim 2, wherein said cover plate is press fit over said recess.

4. The infill adaptor of claim 3, wherein said cover plate has a perimeter generally corresponding to the contour of said recess for being removably received by said recess.

5. The infill adaptor of claim 4, wherein said recess has at least one protrusion defined on its contour and extending from said sash member and into said recess for limiting the removal of the cover plate, and wherein the cover plate has a dip corresponding to said at least one protrusion for limiting the removal of the cover plate from the recess.

6. The infill adaptor of claim 1, wherein said fasteners are selected from one of: a screw, nail, bolt, anchor, and rivet.

* * * * *